US009615699B2

(12) United States Patent
Akinpade

(10) Patent No.: US 9,615,699 B2
(45) Date of Patent: Apr. 11, 2017

(54) SOAP STACKING DISPENSER

(71) Applicant: Oluwatoyin Akinpade, Dacula, GA (US)

(72) Inventor: Oluwatoyin Akinpade, Dacula, GA (US)

( * ) Notice: Subject to any disclaimer, the term of this patent is extended or adjusted under 35 U.S.C. 154(b) by 0 days.

(21) Appl. No.: 15/004,262

(22) Filed: Jan. 22, 2016

(65) Prior Publication Data

US 2016/0213202 A1 Jul. 28, 2016

Related U.S. Application Data

(60) Provisional application No. 62/106,897, filed on Jan. 23, 2015.

(51) Int. Cl.
*A47K 5/08* (2006.01)
*A47K 5/03* (2006.01)

(52) U.S. Cl.
CPC . *A47K 5/08* (2013.01); *A47K 5/03* (2013.01)

(58) Field of Classification Search
CPC ..... A47K 5/08; A47K 5/03
USPC ..... 206/77.1; 312/245, 290, 206, 198, 351, 312/248, 213, 328; 221/283, 155, 309; 4/605; 232/43.3, 22
See application file for complete search history.

(56) References Cited

U.S. PATENT DOCUMENTS 2,704,907 A * 3/1955 Durkee ..... A47K 5/02 206/77.1
2,886,917 A * 5/1959 Yates ..... A47K 5/02 206/77.1
3,164,298 A * 1/1965 Repko ..... A47G 19/32 206/738
3,177,048 A * 4/1965 Whatley ..... A47K 5/02 248/311.2
4,767,022 A * 8/1988 Oldorf ..... G07F 11/18 221/191
4,934,640 A 6/1990 Bichon
4,938,345 A 7/1990 Bolton
D313,714 S 1/1991 Pendill
D317,384 S 6/1991 Powell
5,072,997 A * 12/1991 Mayfield, III ..... A47F 1/08 312/124
D347,536 S * 6/1994 Berreth ..... D6/524
5,425,474 A * 6/1995 Dalea ..... B65D 5/725 206/499
D359,867 S 7/1995 Elldrege
5,467,894 A * 11/1995 Altonen ..... A47F 5/112 206/499
5,570,938 A * 11/1996 Butler ..... A47K 10/22 211/59.1
5,894,612 A 4/1999 Wilson
5,984,440 A * 11/1999 Watson ..... A47K 5/02 206/77.1

(Continued)

*Primary Examiner* — Rakesh Kumar

(74) *Attorney, Agent, or Firm* — Wayne Edward Ramage; Baker Donelson

(57) ABSTRACT

A device for storing multiple bars of soap in a stack. The device is water-proof or water-resistant, and securely stores each bar of soap in a separate enclosure or compartment in a vertical stack. The number of compartments may vary, and any number of compartments may be used. Each compartment is separated by a removable separator or slab, and the bar of soap in each compartment becomes accessible upon removal or repositioning of the separator or slab.

16 Claims, 23 Drawing Sheets

(56) References Cited

U.S. PATENT DOCUMENTS

| | | | | |
|---|---|---|---|---|
| 6,158,615 | A * | 12/2000 | Hill | G07F 11/04 221/154 |
| 6,343,845 | B1 * | 2/2002 | Woodard | A47K 3/281 312/213 |
| D475,873 | S | 6/2003 | Mello | |
| 7,287,668 | B1 * | 10/2007 | Renaud | A47K 5/08 221/155 |
| 8,006,859 | B2 * | 8/2011 | Clarke | A47F 1/04 220/500 |
| 8,936,176 | B2 * | 1/2015 | Roe | A01K 1/031 119/452 |
| 2002/0145004 | A1 * | 10/2002 | Bennett | A47F 5/11 221/311 |
| 2012/0199604 | A1 * | 8/2012 | Brown | G07F 11/22 221/289 |
| 2016/0213202 | A1 * | 7/2016 | Akinpade | A47K 5/03 |

* cited by examiner

CROSS-SECTION BACK TO FRONT

SECTION A-A

CROSS-SECTION LEFT SIDE TO RIGHT SIDE

RIGHT SIDE

RIGHT SIDE

BOTTOM

LEFT SIDE

TOP (closed)

TOP (open)

SOAP STACKING DISPENSER

This application claims benefit of and priority to U.S. Provisional Application No. 62/106,897, filed Jan. 23, 2015, and is entitled to that filing date for priority. The specification, figures, and complete disclosure of U.S. Provisional Application No. 62/106,897 are incorporated herein in their entireties by specific reference for all purposes.

FIELD OF INVENTION

This invention relates to a device for holding multiple bars of soap and dispensing same.

SUMMARY OF INVENTION

In various embodiments, the present invention comprises a device for storing multiple bars of soap in a stack. The device is water-proof or water-resistant, and securely stores each bar of soap in a separate enclosure or compartment in a vertical stack. The number of compartments may vary, and any number of compartments may be used.

Each compartment is separated by a removable separator or slab. When a new bar of soap is needed, the user pulls or removes the next separator or slab, causing the soap in that compartment to fall. In several embodiments, the bar of soap released falls to a holder at the bottom of the device that holds the soap bar currently in use. The holder may be wholly or partially flat with a front lip or edge to prevent the soap from falling out of the holder. In one embodiment, the rear of the holder may be higher than the middle or front of the holder so that the soap is encouraged to slide forward to the front of the holder for easier access. The holder may have grooves, slots, holes, or a combination thereof, to allow water to flow out from under or around the soap. Water may flow towards the front of the holder due to the slope, then exit to the sides before reaching the front lip.

The device may be made of any suitable material, including, but not limited to, plastic. The device may be any color, or transparent, or comprise luminescent, phosphorescent, or glow-in-the-dark material, in whole or in part. The device may be used in a shower, and attached to the shower head, handle, knob or wall by means known in the art (e.g., a hook or loop extending from the top of the device). In one embodiment, one or more suction cups are located on the back on the device and the device is attached to a shower wall or door.

The separators or slabs may be single use or reusable. Separators may be provided with handles or a lip to assist the user in removing or inserting the separator.

In one embodiment, the device may come "pre-loaded" with several bars of soap already in the separate compartments. The user removes the bottom-most separator, causing the bar of soap in the bottommost compartment to fall to the soap holder for use. The separator may be disposed of. As each bar of soap is used, the user moves up the device, removing the next lowest separator at the appropriate time. Eventually, all bars of soap are used, and the device may be disposed of after the last bar is used.

Alternatively, separators may be put back into place by the user. The user removes and reinserts each separator in sequence, causing the entire stack of soap to move down one compartment. For example, the user pulls the lowermost separator to release the soap in the bottommost compartment for use, then reinserts it after the soap falls to the holder. The user then pulls the next lowest separator to release the soap in the next lowest compartment, which falls to the bottom-most compartment, which was empty, and reinserts the separator. This is repeated for each compartment.

DETAILED DESCRIPTION OF EXEMPLARY EMBODIMENTS

Figure 1:
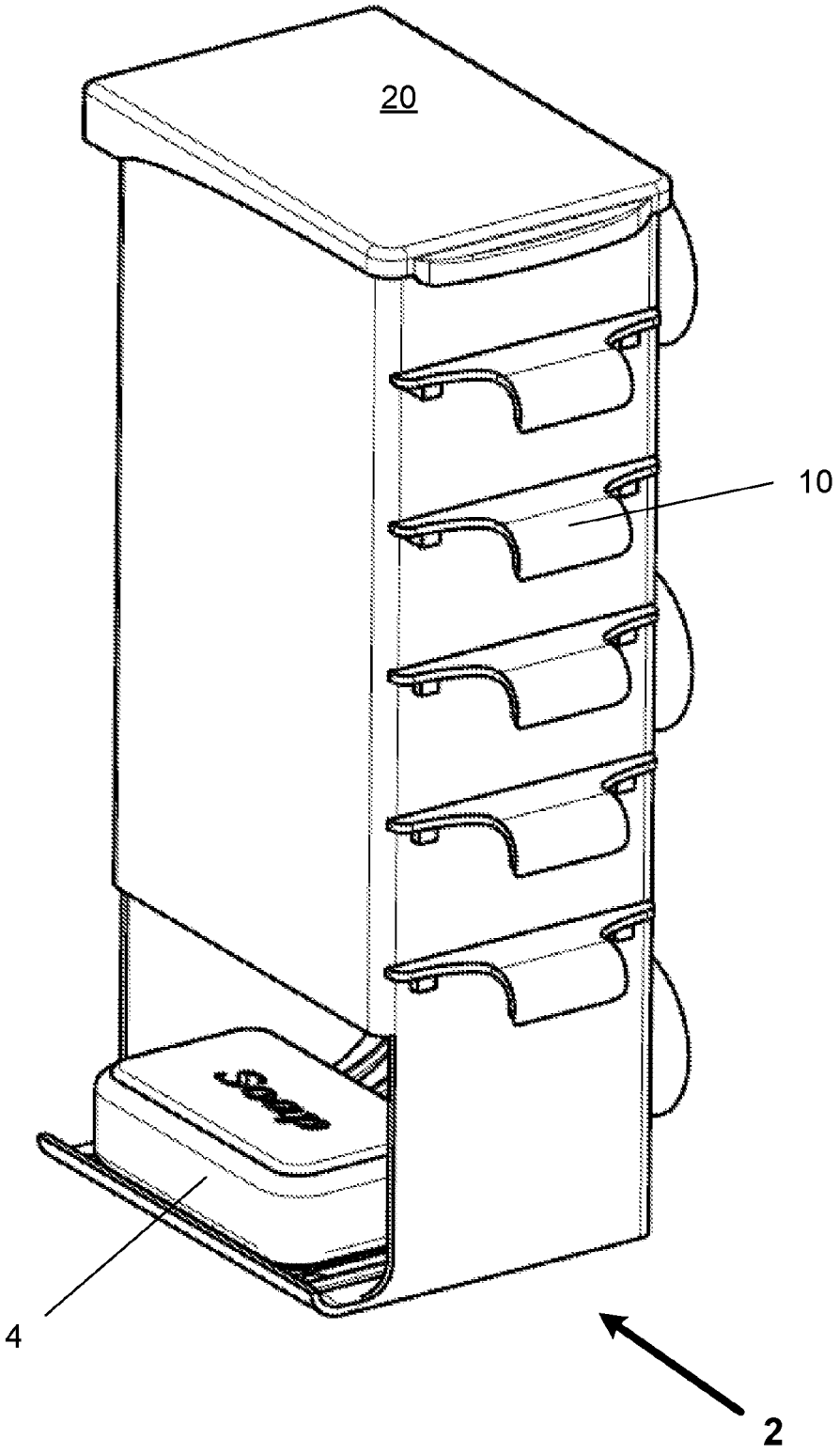
FIG. 1 shows a front perspective view of a device in accordance with an exemplary embodiment of the present invention.
Figure 2:
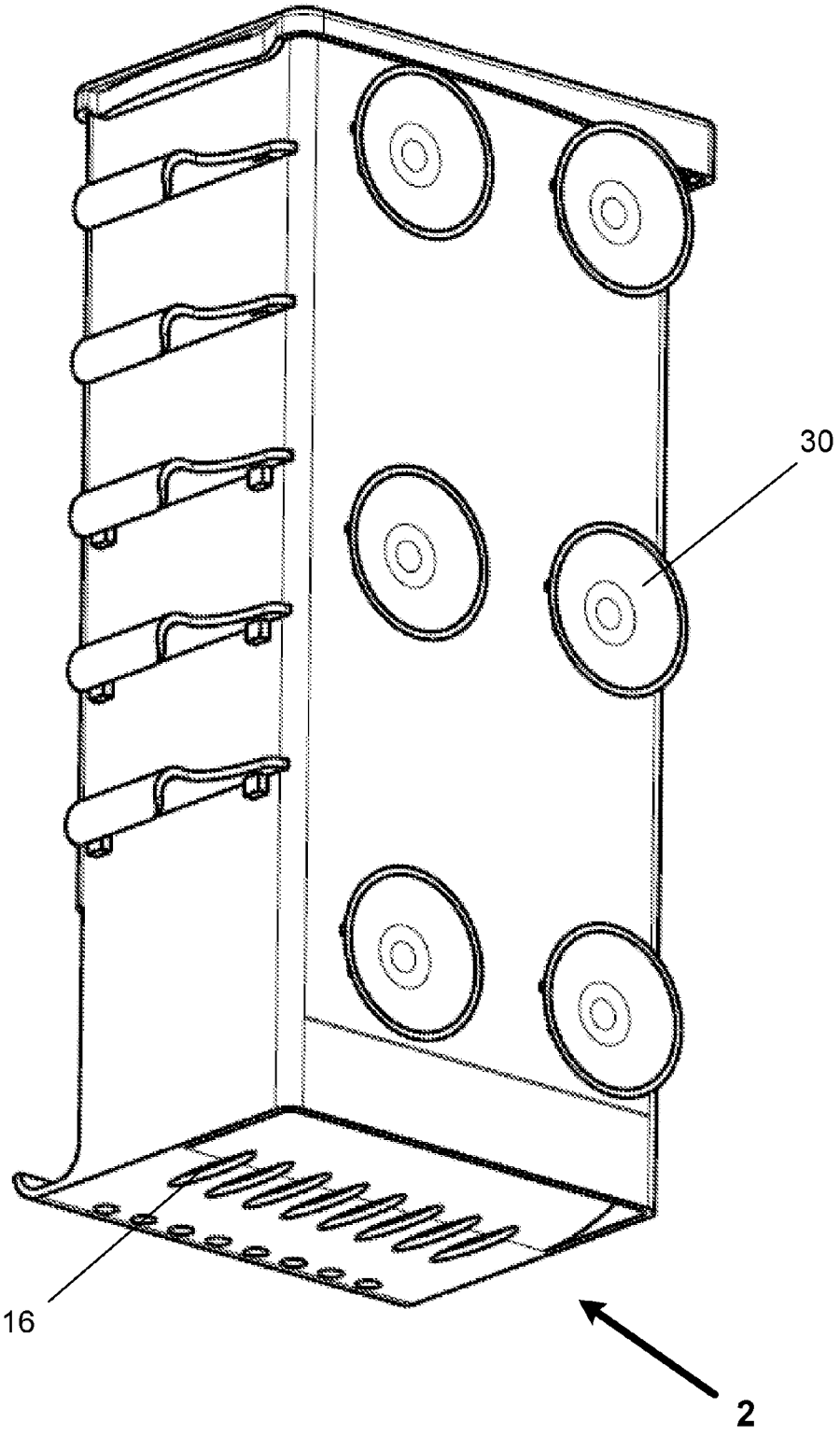
FIG. 2 shows a back perspective view of the device of FIG. 1.
Figure 3:
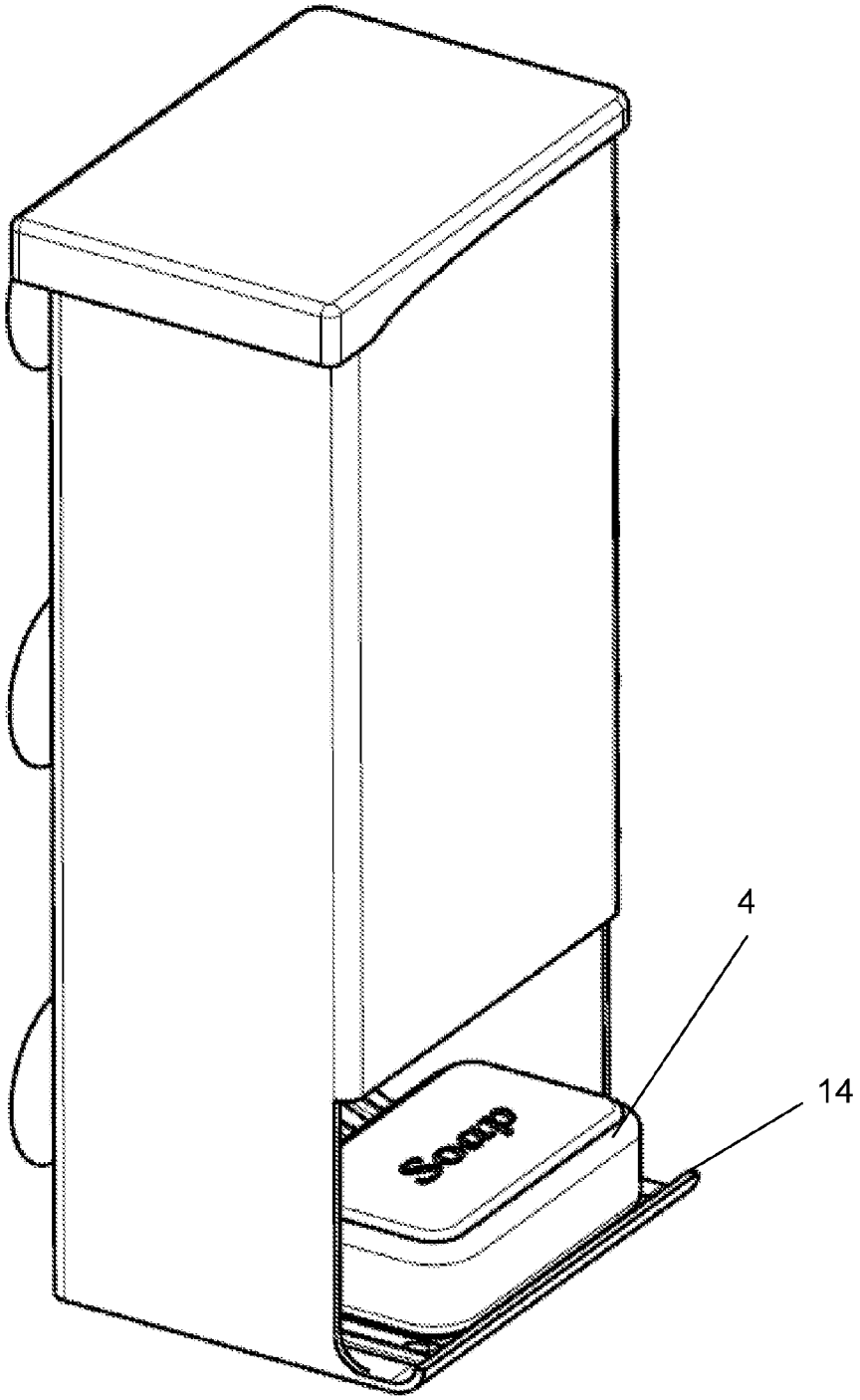
FIGS. 3 and 4 show perspective views of the device of FIG. 1.
Figure 4:
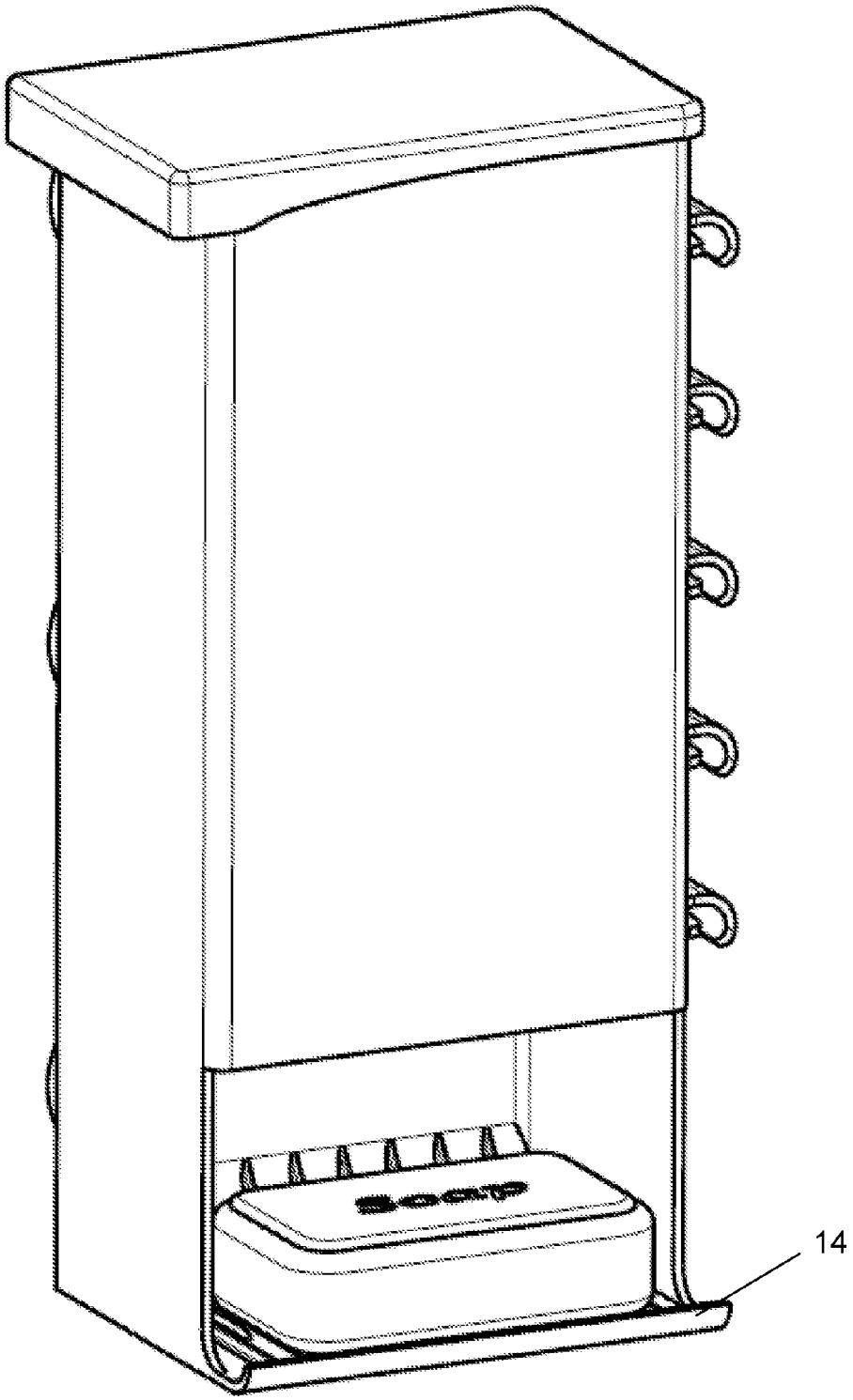
Figure 5:
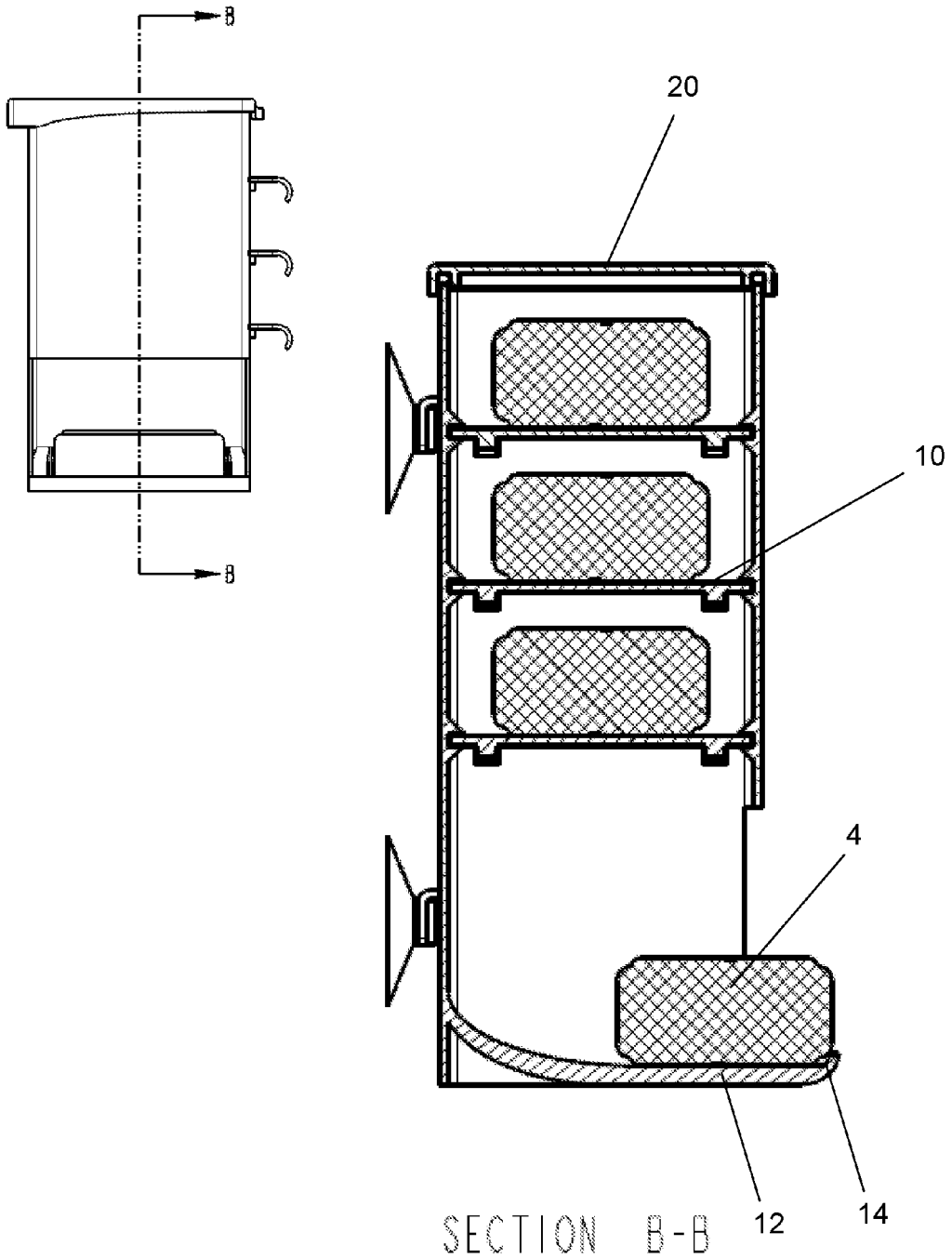
FIG. 5 shows a side cross-sectional view of a device in accordance with another exemplary embodiment of the present invention.
Figure 6:
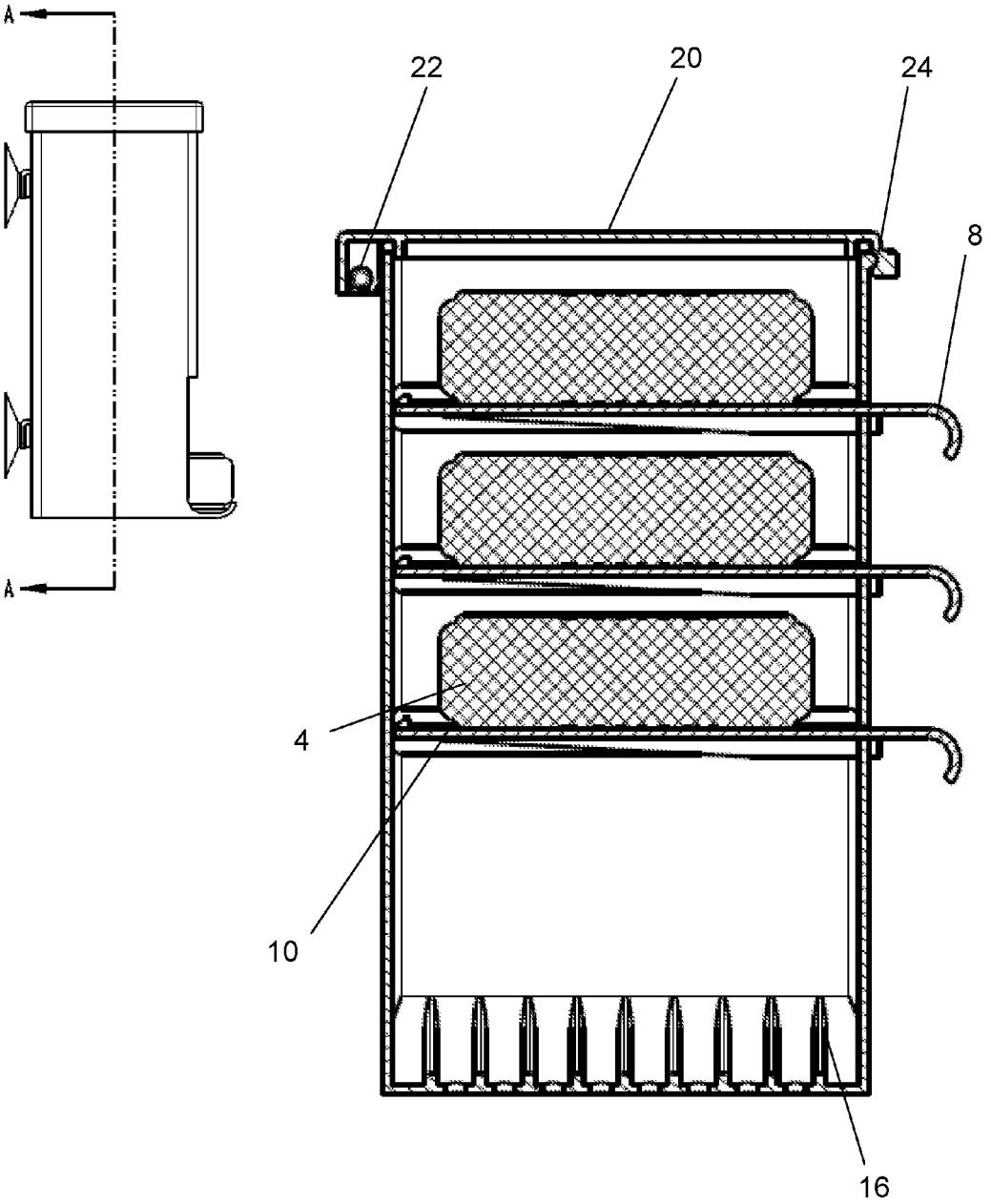
FIG. 6 shows a front cross-sectional view of the device of FIG. 5.
Figure 7:
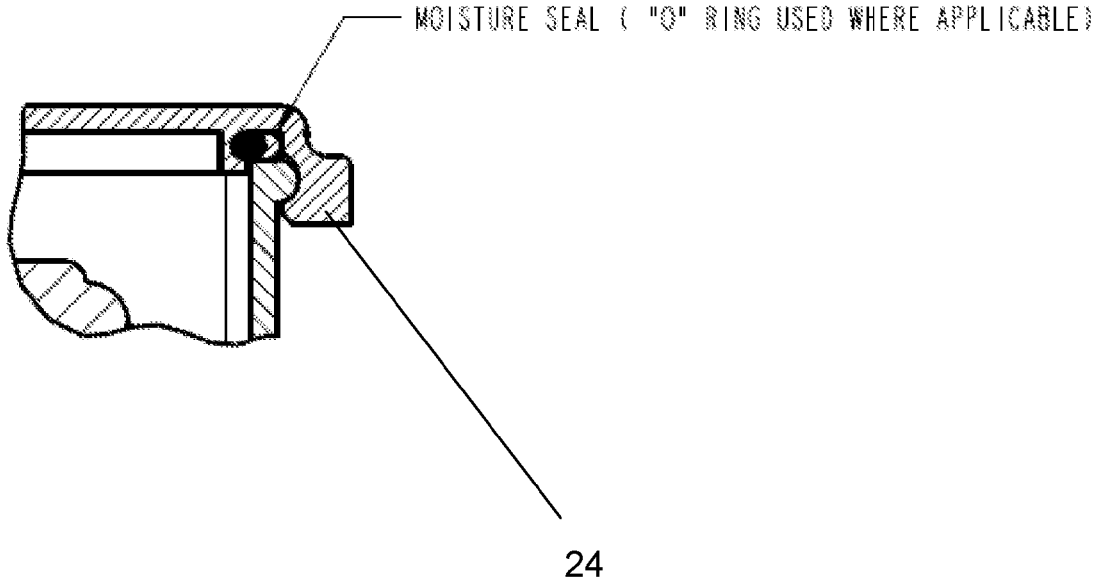
FIG. 7 shows a close-up sectional view of a moisture seal.
Figure 8A:
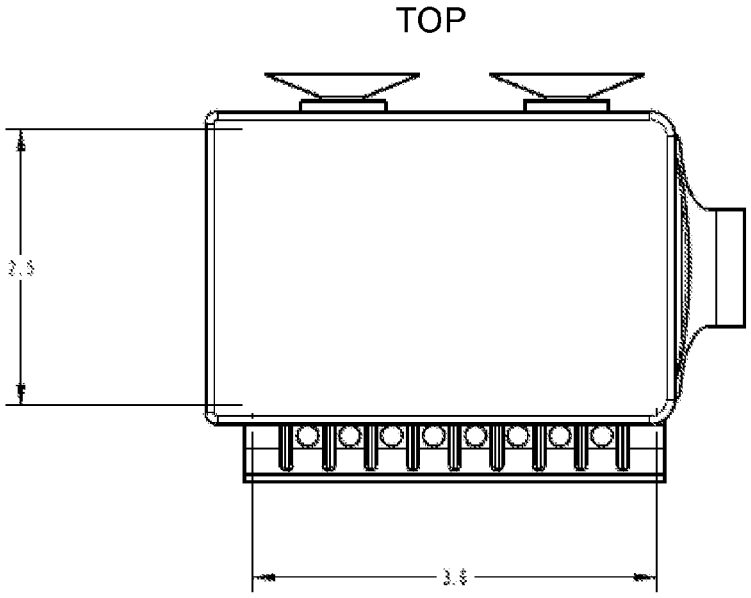
FIG. 8A is a top view of the device of FIG. 5.
Figure 8B:
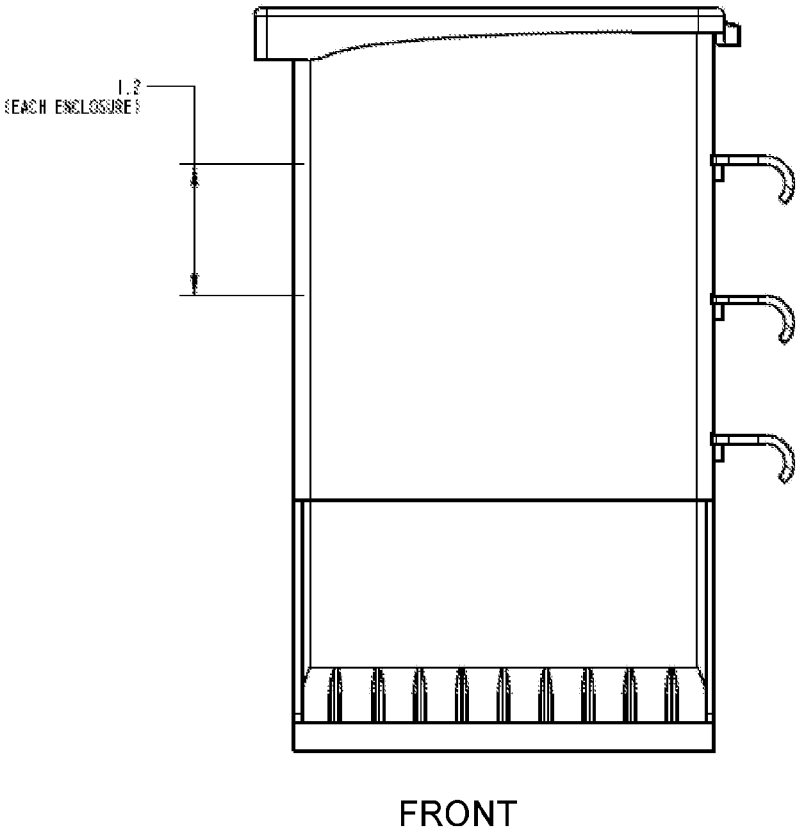
FIG. 8B is a front view of the device of FIG. 5.
Figure 9:
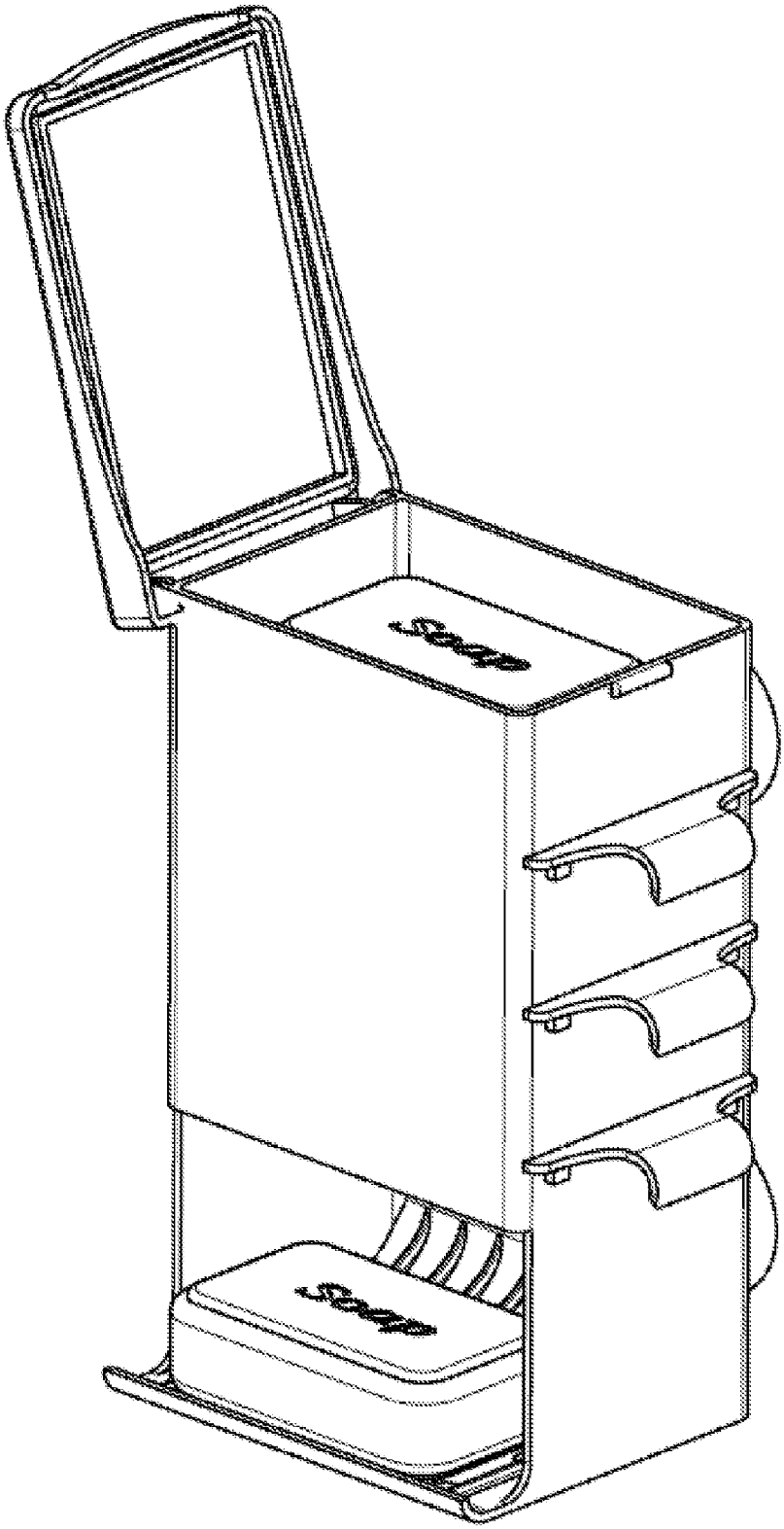
FIG. 9 is a perspective view of the device of FIG. 5.
Figure 10A:
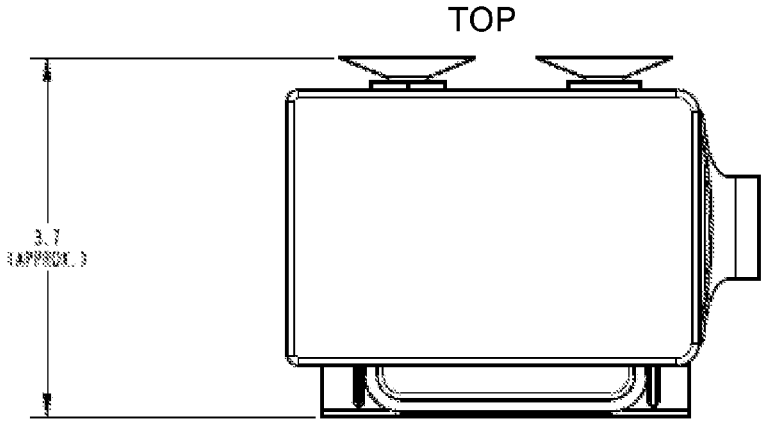
FIG. 10A is a top view of the device of FIG. 1.
Figure 10B:
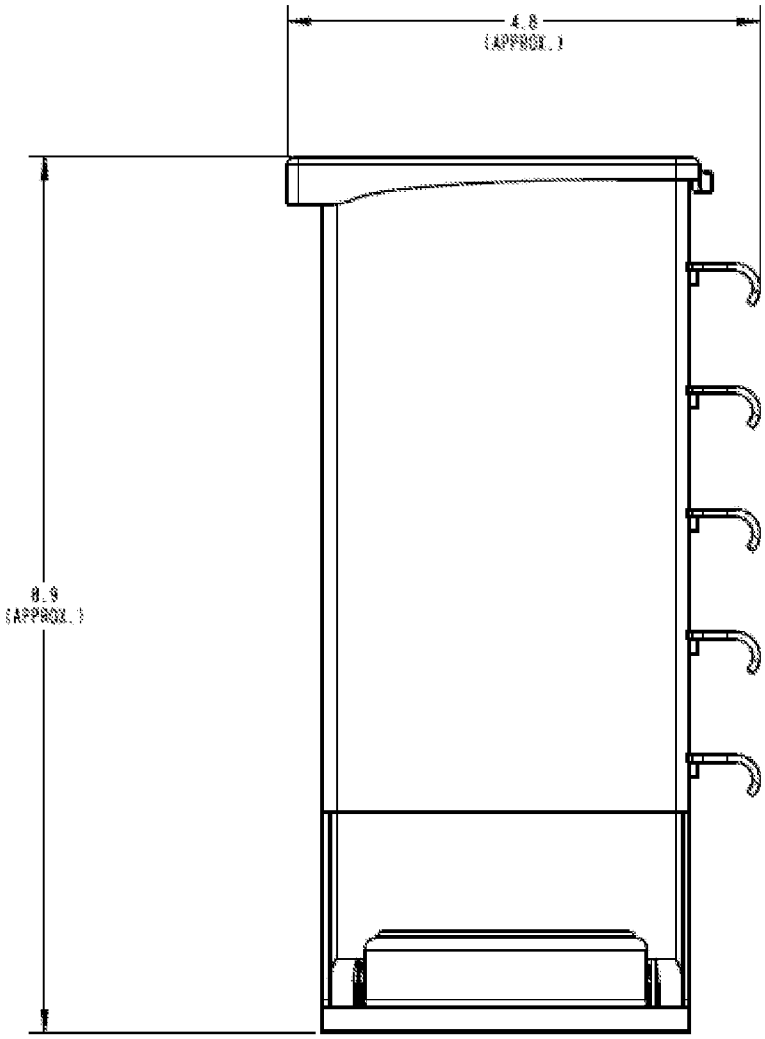
FIG. 10B is a front view of the device of FIG. 1.
Figure 11A:
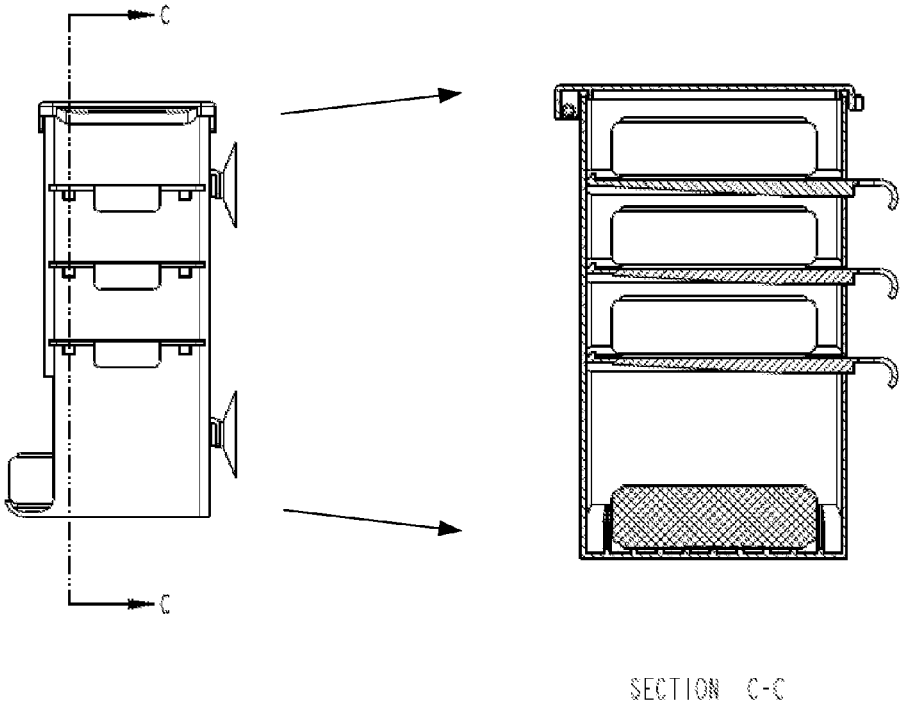
FIG. 11A is a cross-sectional view of the device of FIG. 5.
Figure 11B:
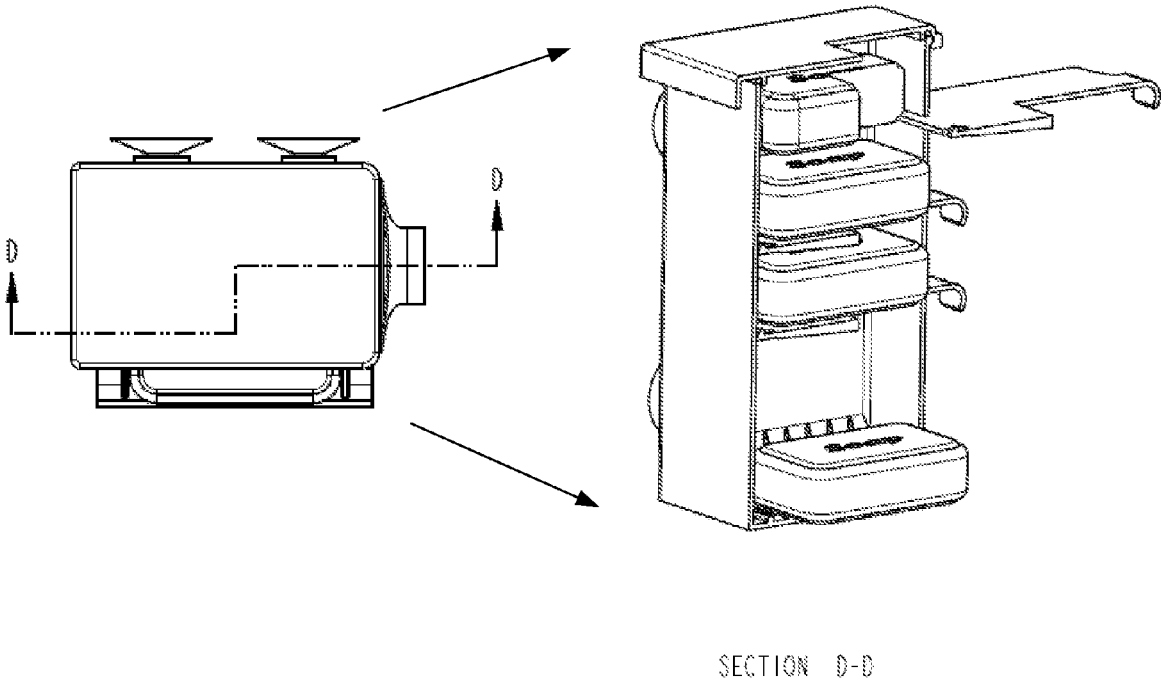
FIG. 11B is another cross-sectional view of the device of FIG. 5.
Figure 12A:
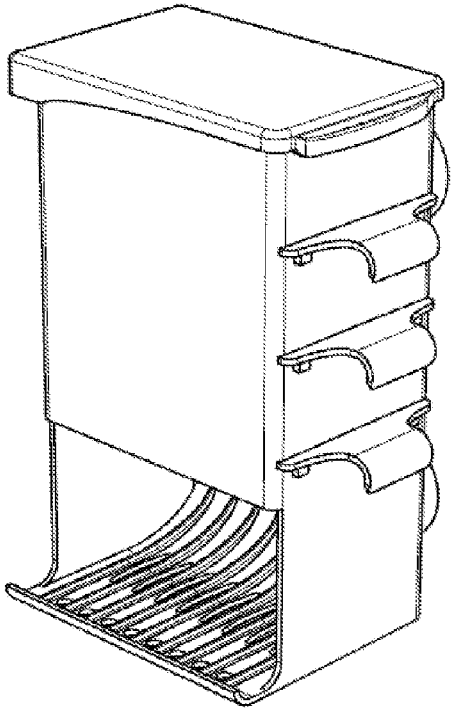
FIGS. 12A-C are perspective views of the device of FIG. 5.
Figure 12B:
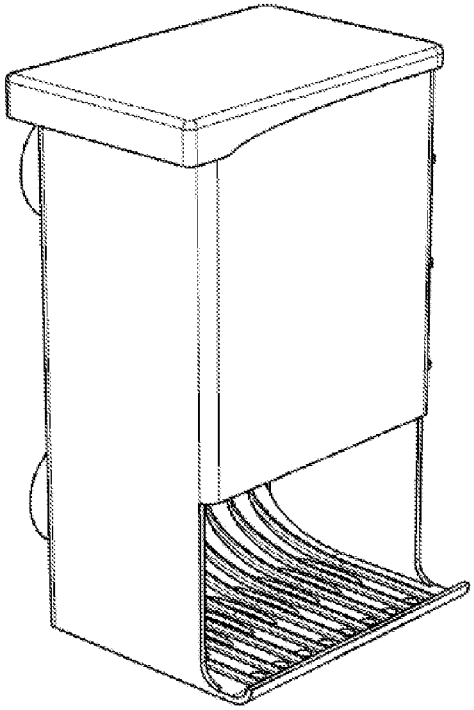
Figure 12C:
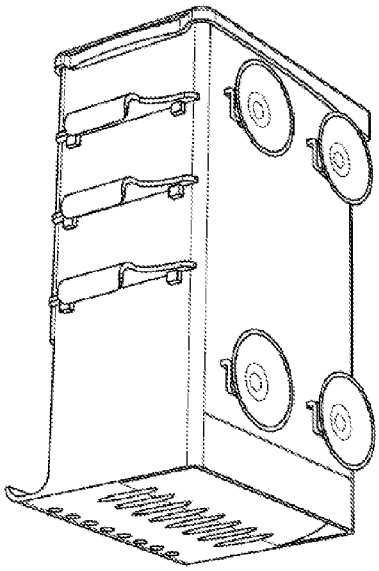
Figure 13A:
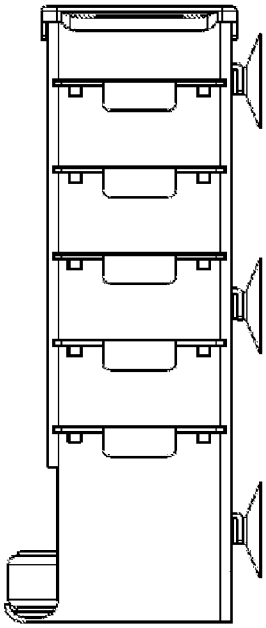
FIG. 13A is a right side view of the device of FIG. 1.
Figure 13B:
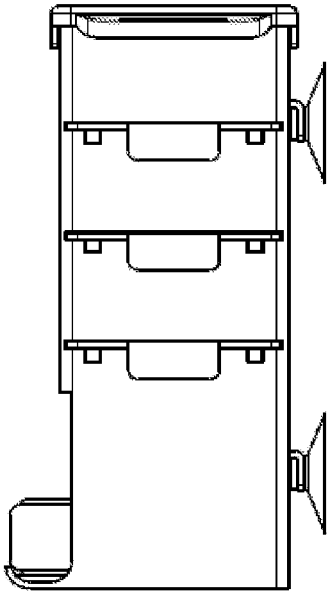
FIG. 13B is a right side view of the device of FIG. 5.
Figure 13C:
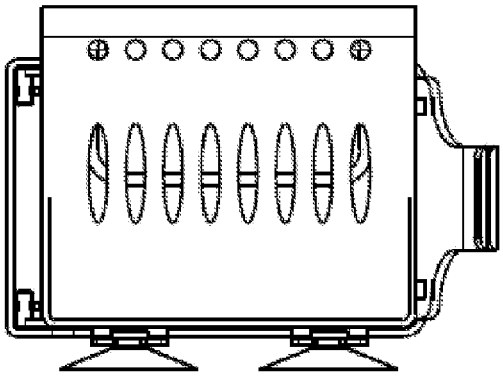
FIG. 13C is a bottom view of the device of FIG. 1.
Figure 13D:
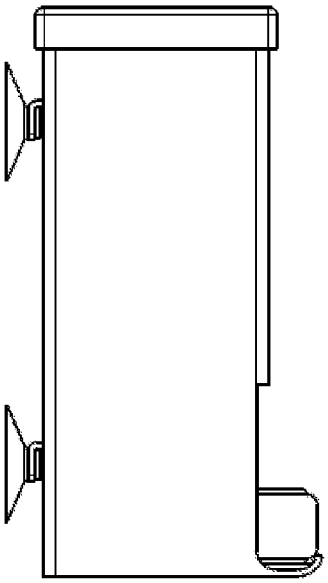
FIG. 13D is a left side view of the device of FIG. 5.
Figure 14A:
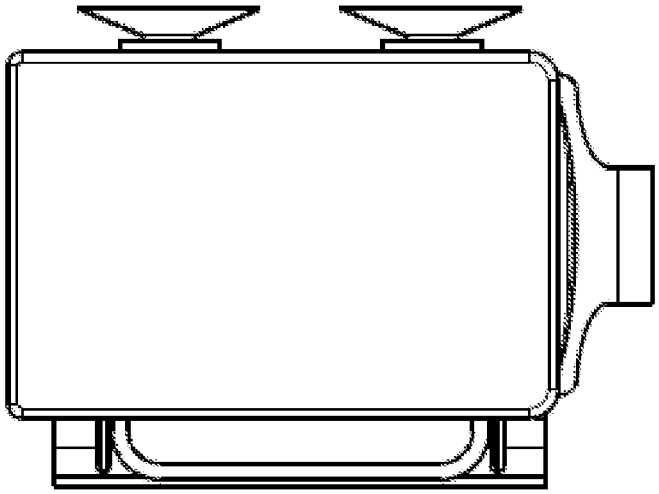
FIGS. 14A-B are top views of the device of FIG. 5 with the top closed and opened.
Figure 14B:
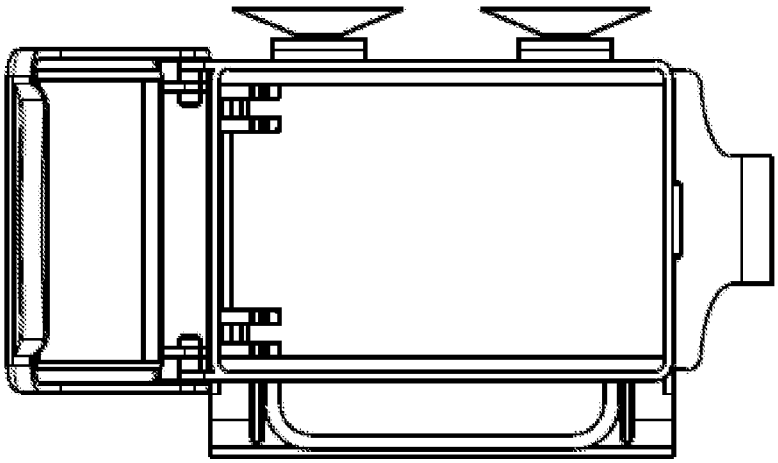
Figure 15A:
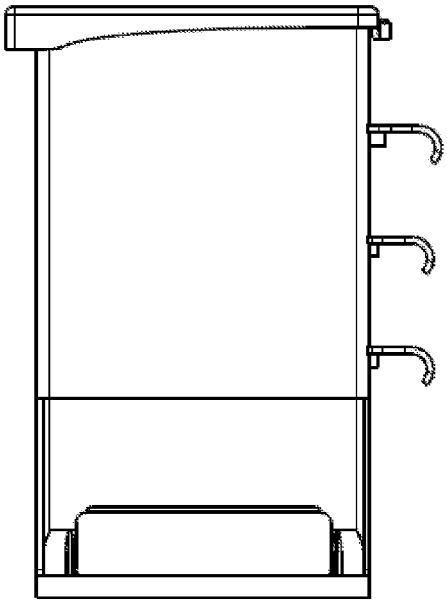
FIG. 15A is a front view of the device of FIG. 5 with the top closed.
Figure 15B:
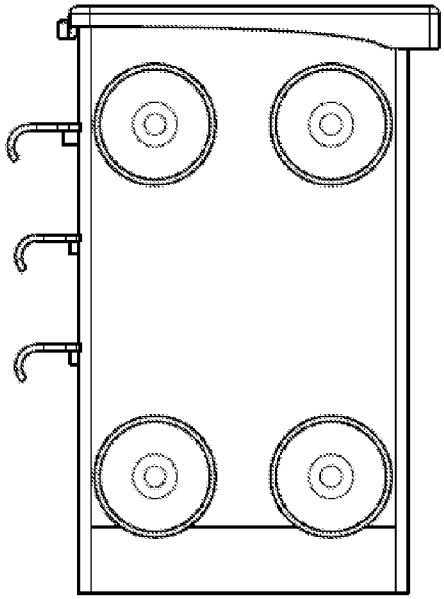
FIG. 15B is a back view of the device of FIG. 5 with the top closed.
Figure 15C:
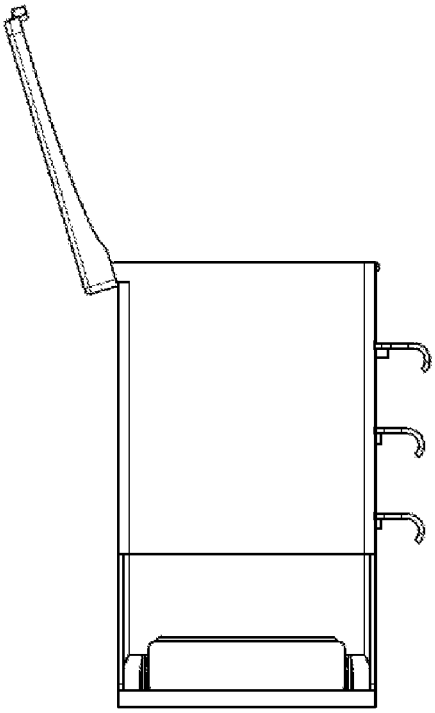
FIG. 15C is a front view of the device of FIG. 5 with the top opened.
Figure 15D:
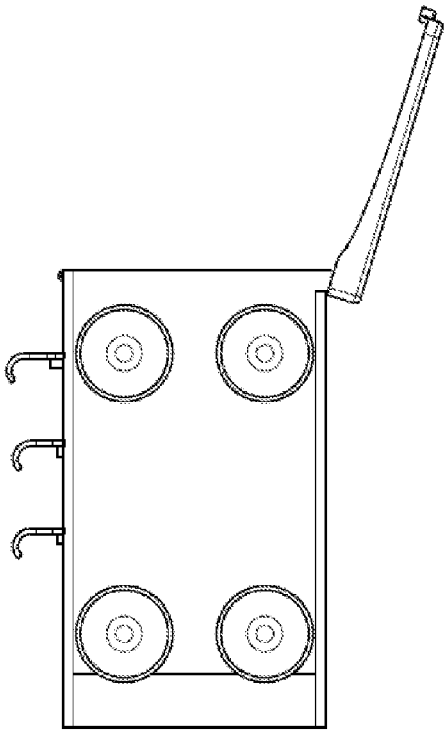
FIG. 15D is a back view of the device of FIG. 5 with the top opened.
Figure 16:
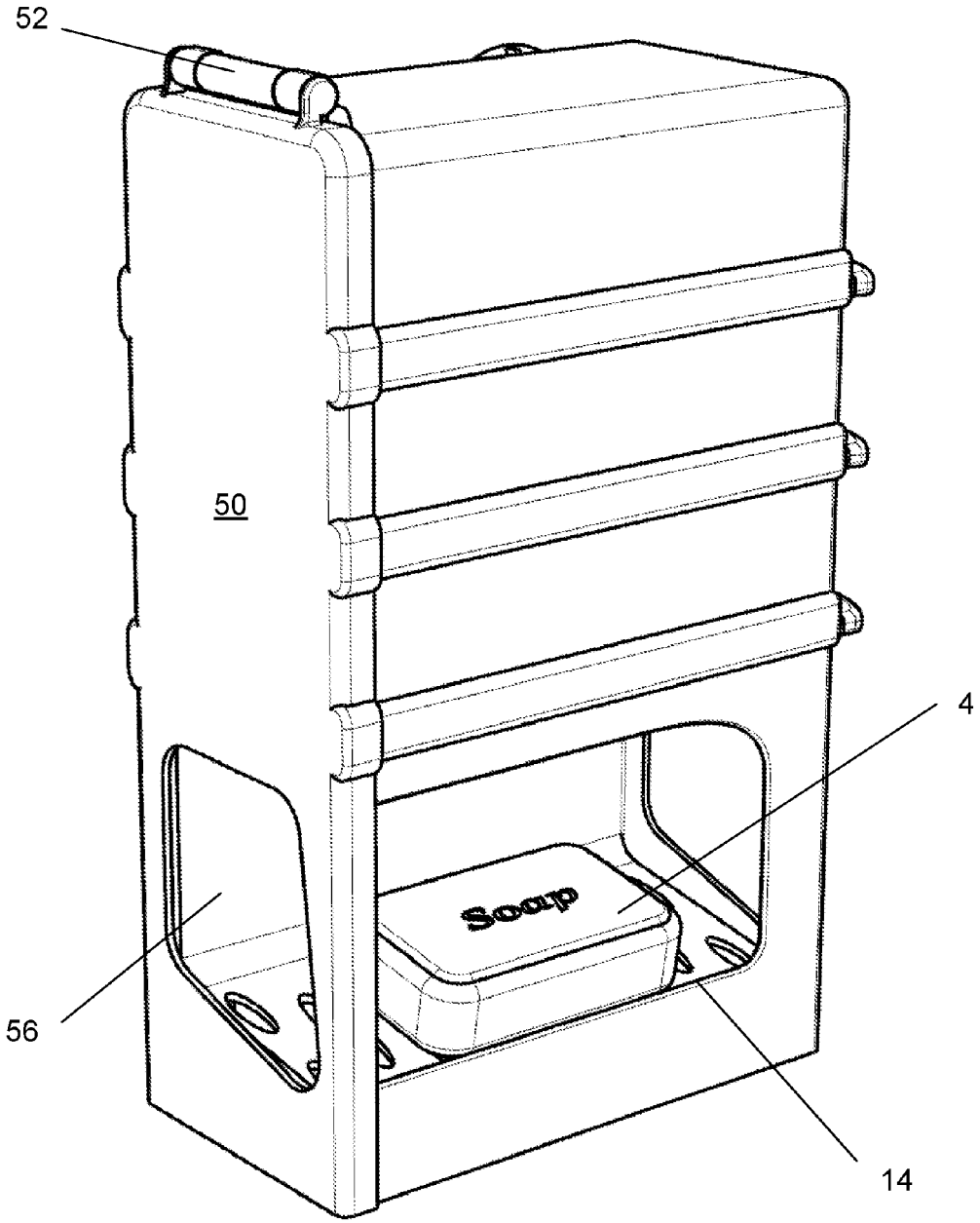
FIG. 16 is a front perspective view of a side-hinged device in accordance with another exemplary embodiment of the present invention.
Figure 17:
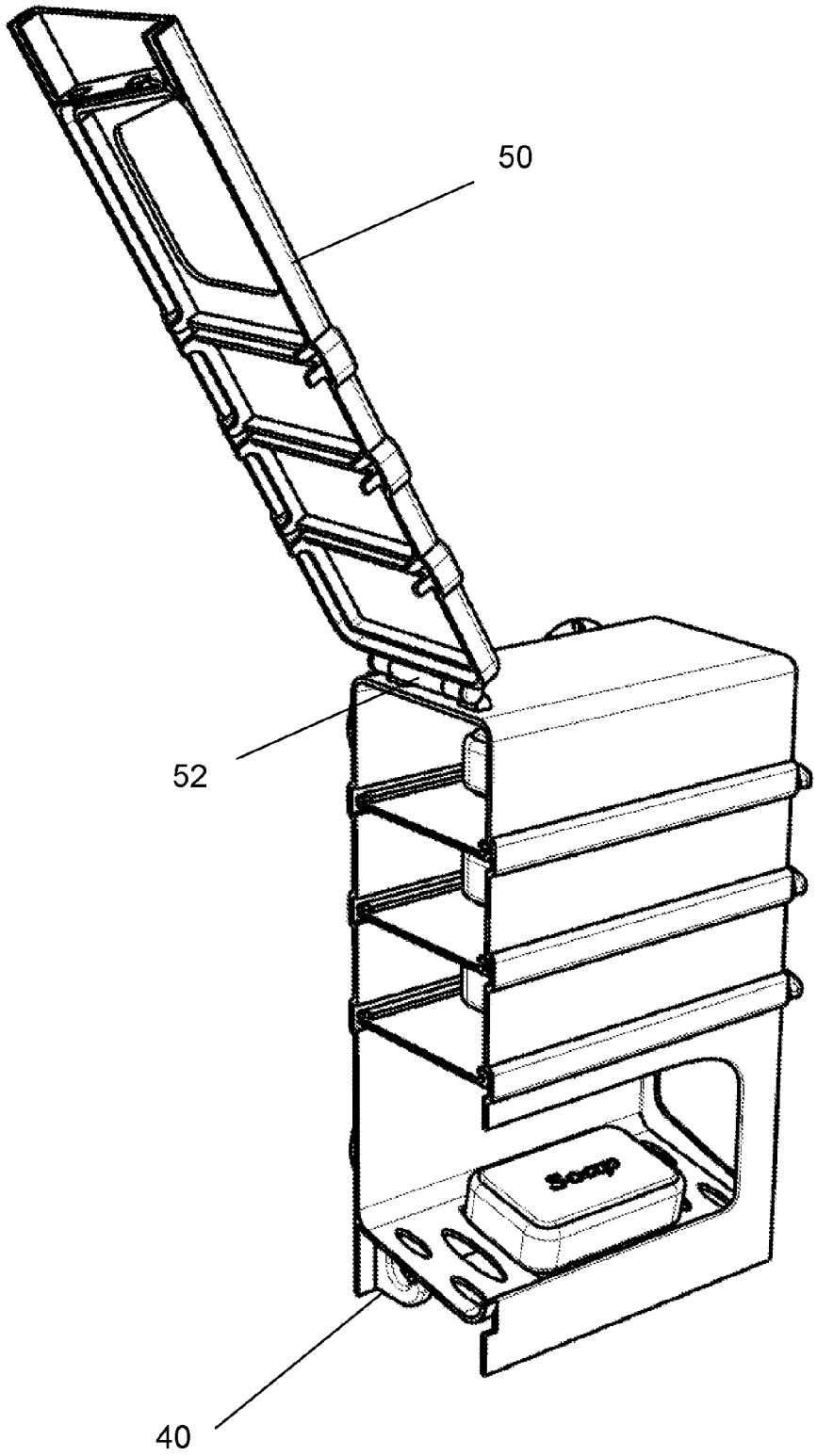
FIG. 17 is a front perspective view of the device of FIG. 16 with the side opened.
Figure 18:
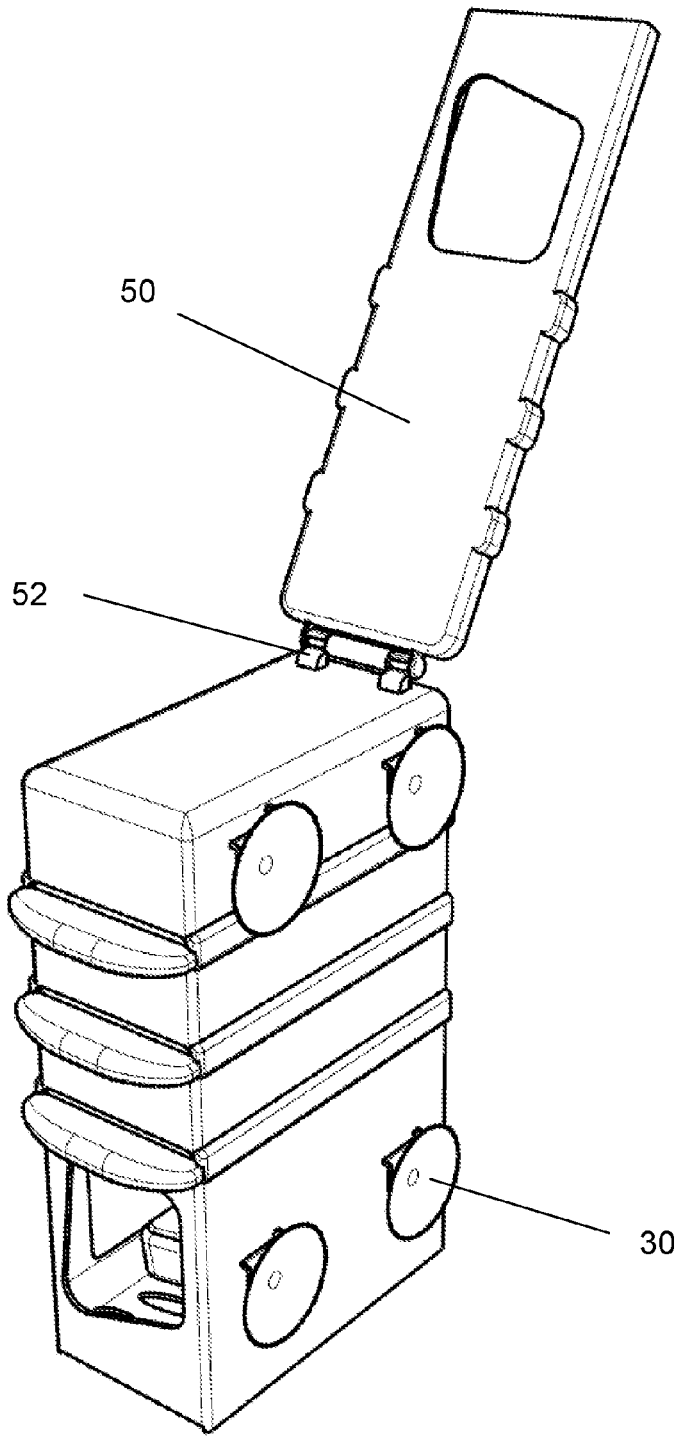
FIG. 18 is a back perspective view of the device of FIG. 16 with the side opened.

In various exemplary embodiments, the present invention comprises a device 2 for storing multiple bars of soap 4 in a stack. The device is water-proof or water-resistant, and securely stores each bar of soap in a separate enclosure or compartment 6 in a vertical stack. The figures show embodiments with three and five compartments, but the number of compartments may vary, and any number of compartments may be used.

Each compartment is separated by a removable separator or slab 10. When a new bar of soap is needed, the user pulls or removes the next separator or slab 10, causing the soap in that compartment to fall. In several embodiments, the bar of soap released falls to a holder 12 at the bottom of the device that holds the soap bar currently in use. The holder 12 may be wholly or partially flat with a front lip or edge 14 to prevent the soap from falling out of the holder. In one embodiment, the rear of the holder may be higher than the middle or front of the holder so that the soap is encouraged to slide forward to the front of the holder for easier access. The holder may have grooves, slots, holes, 16 or a combination thereof, to allow water to flow out from under or around the soap. Water may flow towards the front of the holder due to the slope, then exit to the sides before reaching the front lip.

Figure 19:
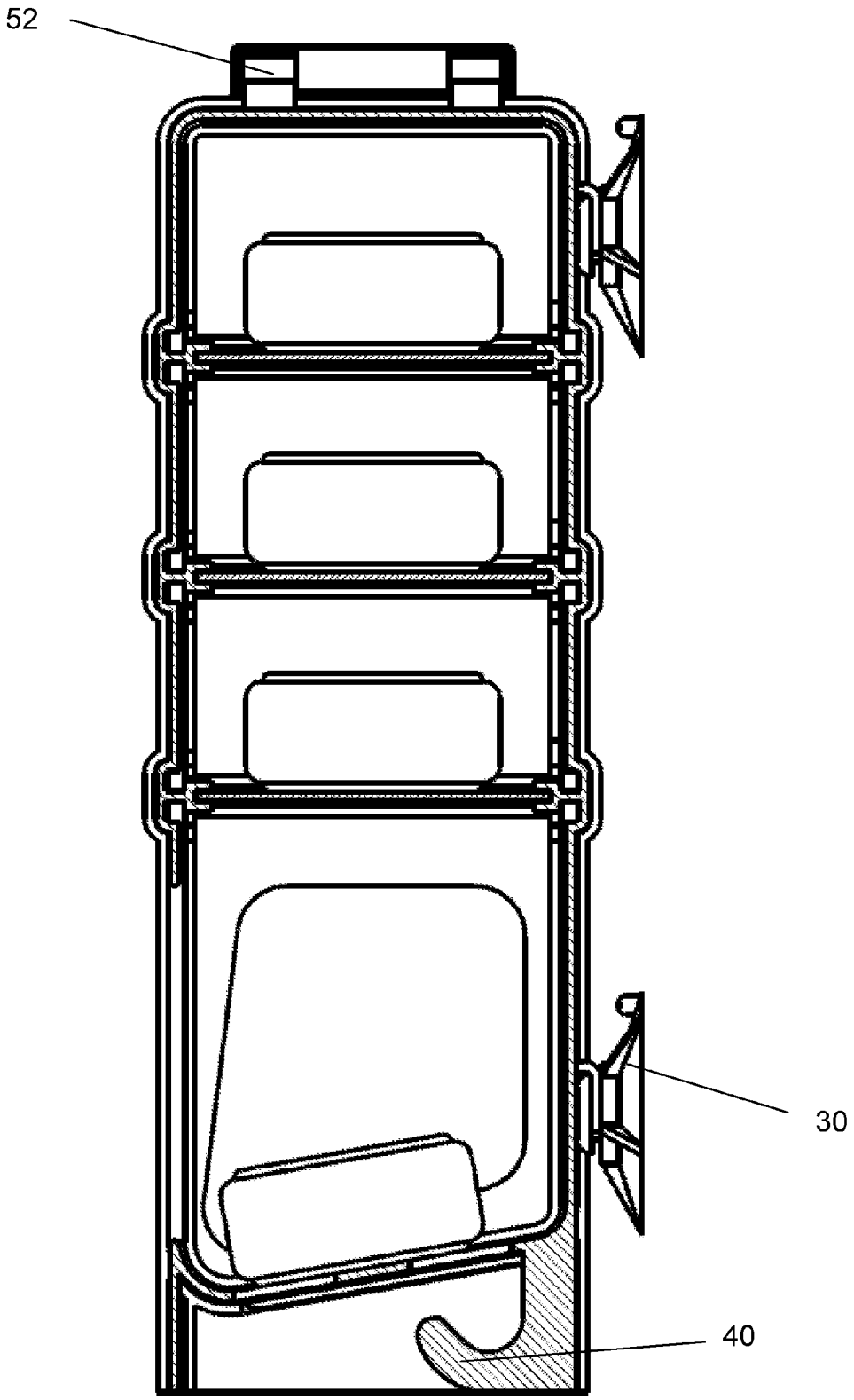
FIG. 19 is a cross-sectional view of the device of FIG. 16.
Figure 20:
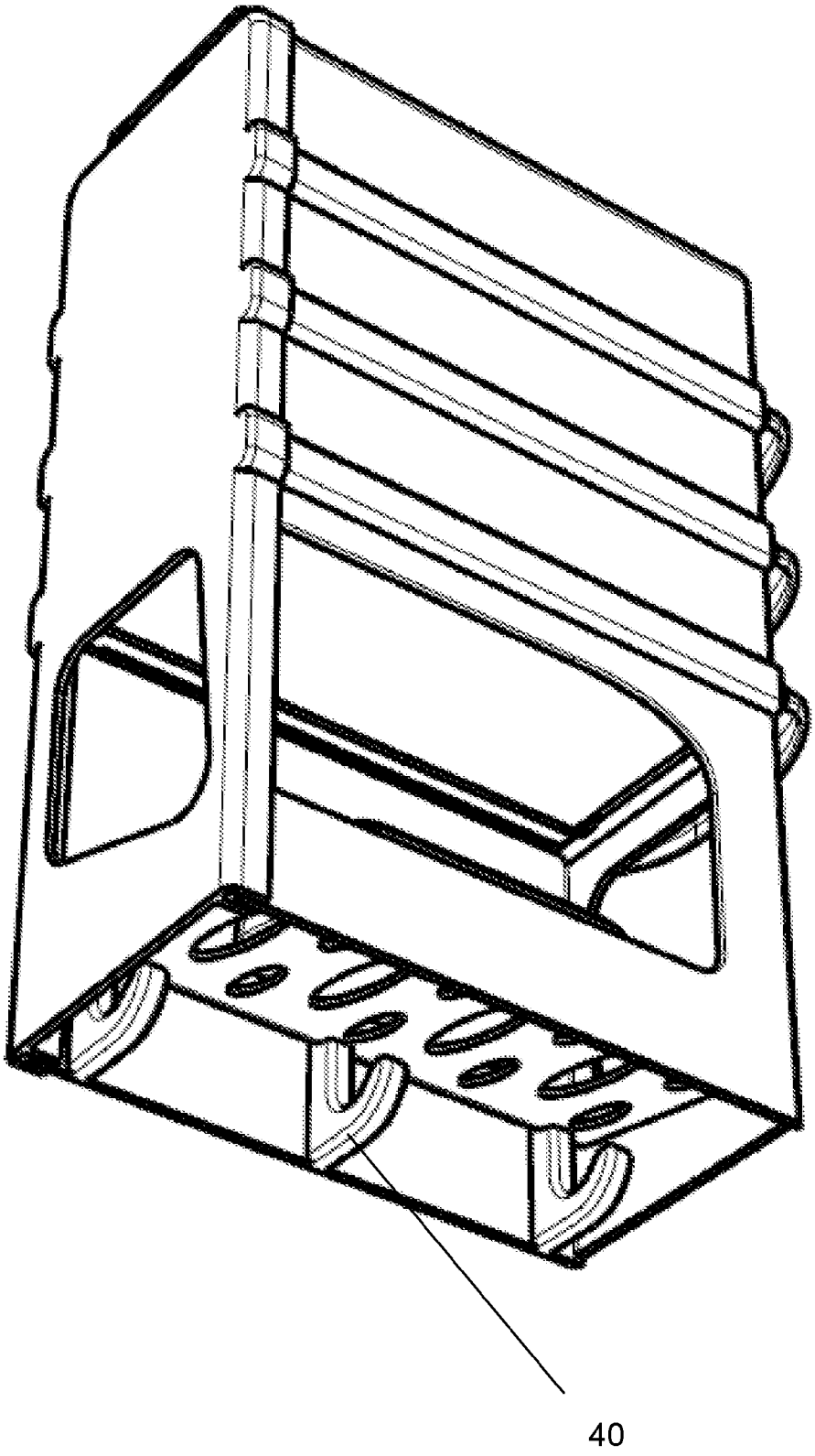
FIGS. 20 and 21 are perspective views of the device of FIG. 16 showing three hooks.
Figure 21:
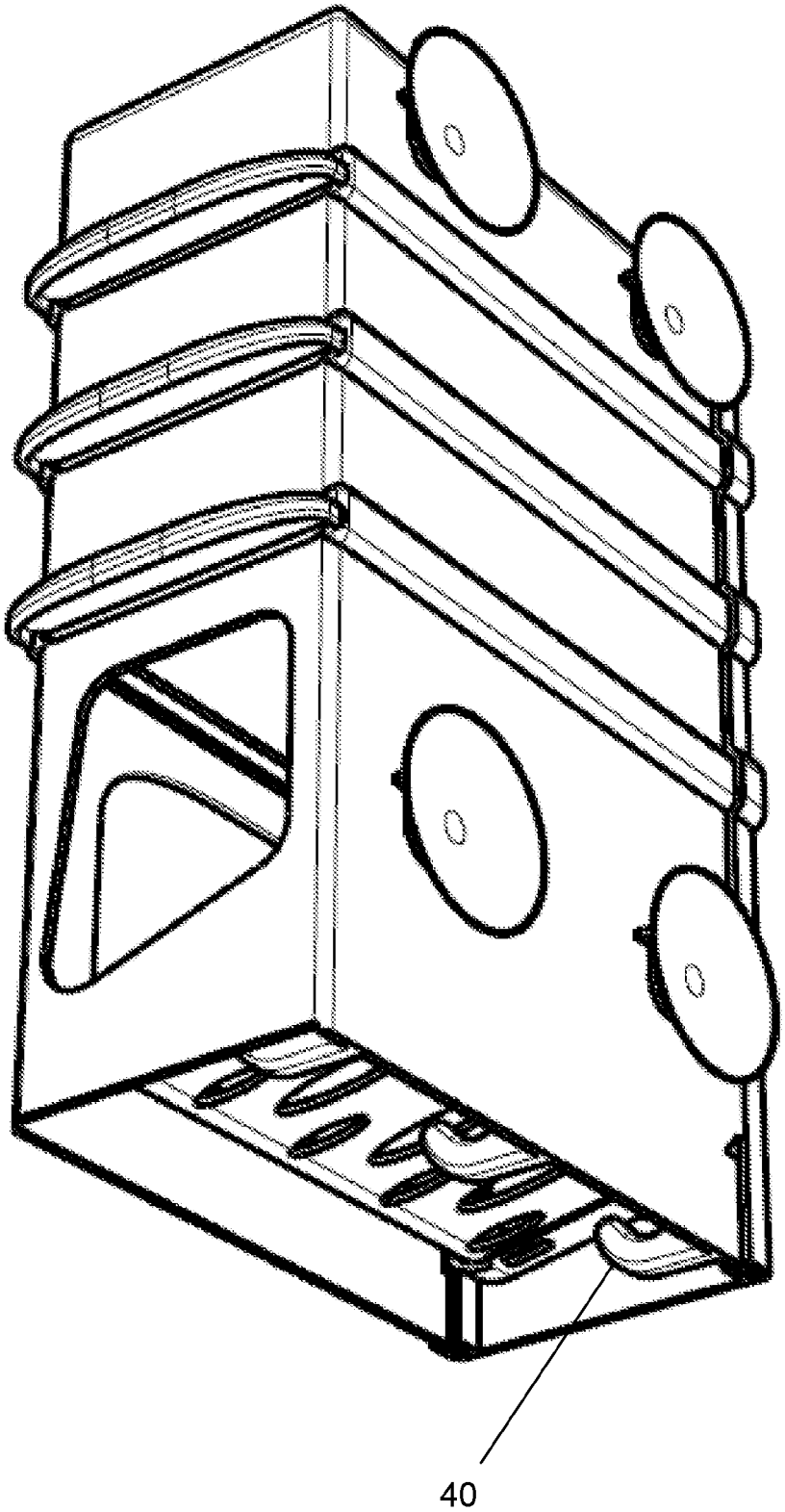
Figure 22:
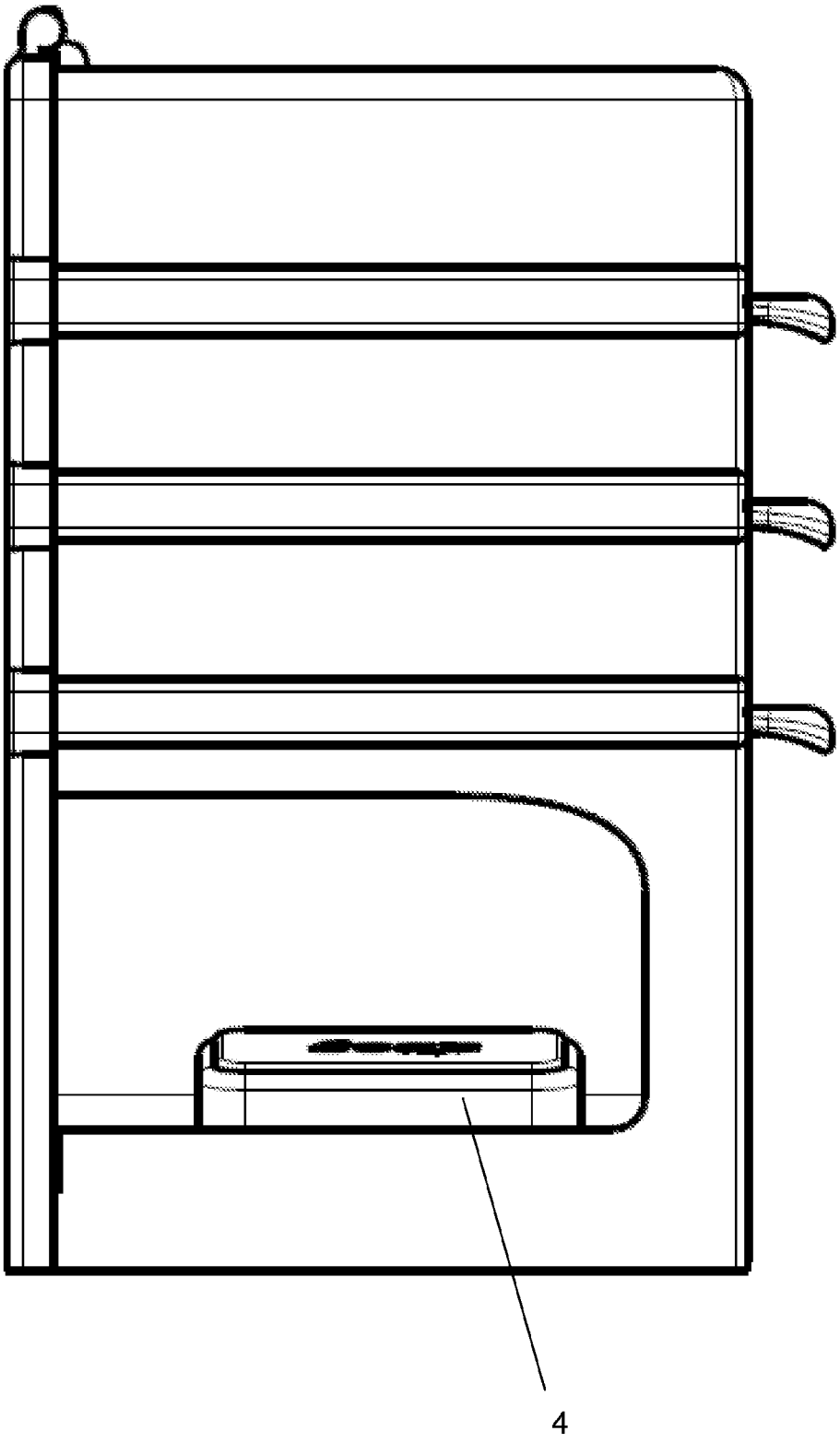
FIG. 22 is a front view of the device of FIG. 16.
Figure 23:
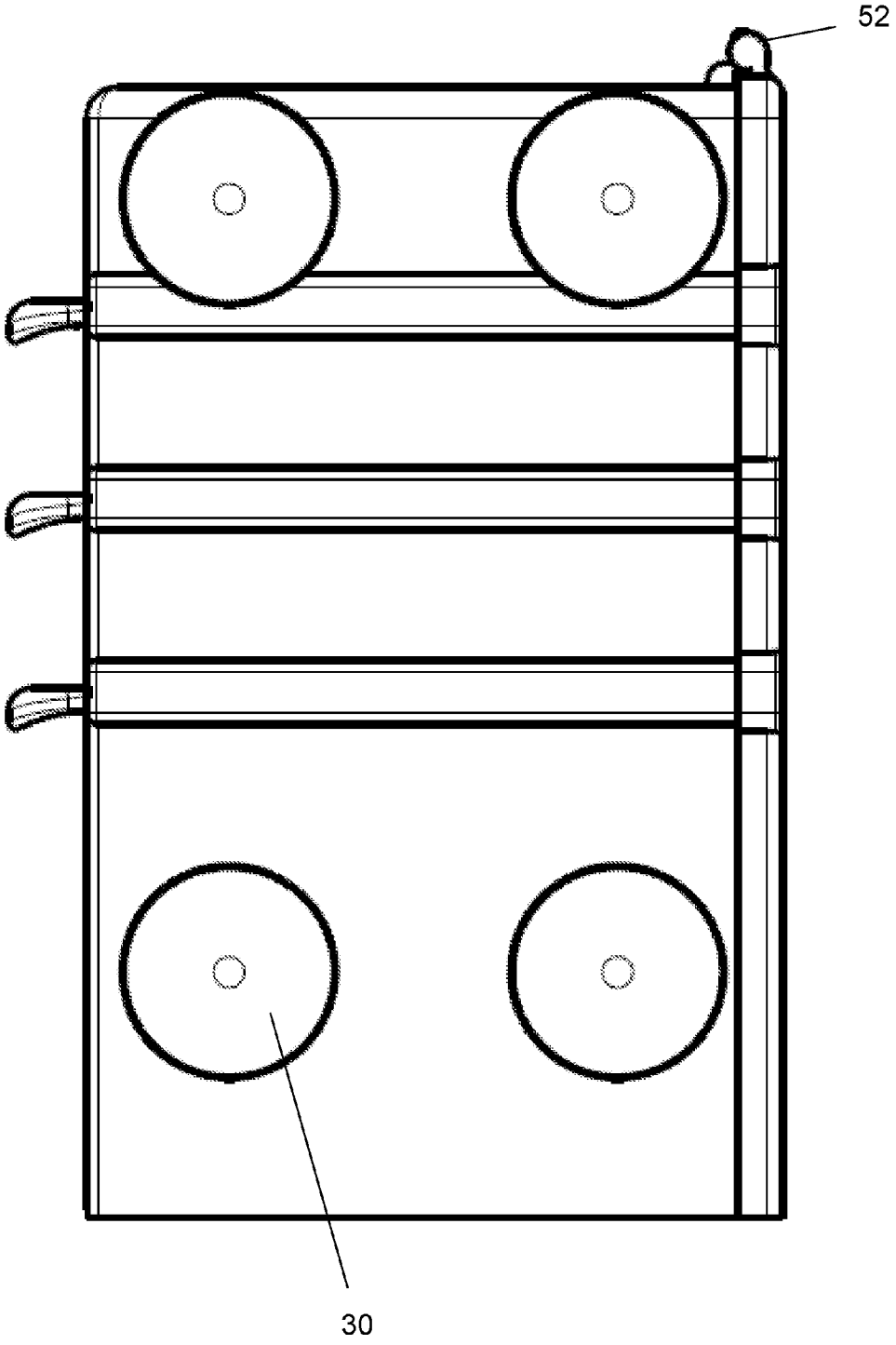
FIG. 23 is a back view of the device of FIG. 16.

The device may be made of any suitable material, including, but not limited to, plastic. The device may be any color, or transparent, or comprise luminescent, phosphorescent, or glow-in-the-dark material, in whole or in part. The device may be used in a shower, and attached to the shower head, handle, knob or wall by means known in the art (e.g., a hook or loop extending from the top of the device). In one embodiment, one or more suction cups 30 are located on the back on the device and the device is attached to a shower wall or door. In several embodiments, one or more hooks 40 or prongs may extend from the bottom, sides, front or elsewhere on the device for hold sponges, wash cloths, or similar items. As seen in FIG. 19, in one embodiment the hooks 40 may be located on the bottom of the device in a protected area (i.e., the hooks do not extend down below the bottom of the sides of the device), which help prevent items from being snagged or the hooks from causing injury to the user.

The separators or slabs may be single use or reusable. Separators may be provided with handles or a lip 8 to assist the user in removing or inserting the separator. In one embodiment, the device may come "pre-loaded" with several bars of soap already in the separate compartments. The user removes the bottom-most separator, causing the bar of soap in the bottommost compartment to fall to the soap holder for use. The separator may be disposed of. As each bar of soap is used, the user moves up the device, removing the next lowest separator at the appropriate time. Eventually, all bars of soap are used, and the device may be disposed of after the last bar is used.

Alternatively, separators may be put back into place by the user. The user removes and reinserts each separator in sequence, causing the entire stack of soap to move down one compartment. For example, the user pulls the lowermost separator to release the soap in the bottommost compartment for use, then reinserts it after the soap falls to the holder. The user then pulls the next lowest separator to release the soap in the next lowest compartment, which falls to the bottommost compartment, which was empty, and reinserts the separator. This is repeated for each compartment.

In one embodiment, the top 20 of the device is removable, in whole or in part, so that new bars of soap can be inserted into the stack. The top may be hinged 22 on one side (e.g., back, right side, left side, or front), and securely closed on another side by a snap-lock, clasp, or similar means 24. Alternatively, the top may be integrated with the body, or permanently closed (i.e., the device would be disposable after all soap is used).

In another embodiment, as seen in FIGS. 16-19, one or both sides 50 of the device may be removable, in whole or in part, so that new bars of soap can be inserted into the stack. The side 50 may be hinged 52 on one end (e.g., top, bottom, back or front), and securely closed by a snap-lock, clasp, or similar means. In the embodiment shows, the side comprises a plurality of slots that slide securely or snugly over corresponding components (e.g., ends) on the body, and separators (when in place). As seen in the figures, the hinged side 50 is solid and forms a tight seal for the compartments where soap is stored, but may have an opening 56 for the portion corresponding to the holder.

The openings for the separators may be sealed with rubber, foam, plastic, or similar material to prevent water from entering the compartments. Similar sealing means may be used for the device top around the edges of the opening to the main body of the device. The openings may be to the sides or the front of the device, or combinations thereof.

In one embodiment, the separators may be entirely removable. If fully removed and not replaced, the opening for the separator may entirely seal so as to prevent the influx of water. In an alternative embodiment, the separators are not entirely removable, and move only to a point sufficient to allow the soap to drop. In the latter embodiment, tabs at the end of the separator may be used to prevent the separator from being fully removed. This reduces damage to the seal, and prevents separators from being lost.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. A device for dispensing soap, comprising:

a main body with a front, back, top, bottom, and right and left side encompassing a hollow interior, the interior comprising a plurality of vertically-stacked compartments, said plurality of vertically-stacked compartments comprising a bottommost compartment disposed at the bottom of the main body, a first compartment disposed vertically above said bottommost compartment, and at least one additional compartment disposed vertically above said first compartment, each compartment adapted to hold a bar of soap, the bottommost compartment being open on one or more sides; and a plurality of separators separating adjacent compartments, wherein each separator extends out through a corresponding slot in the front, right or left side of the main body and is removable therethrough.

2. The device of claim 1, wherein the bottommost compartment comprises an outwardly-extending lip from the bottom of the compartment.

3. The device of claim 1, wherein the bottom of the bottommost compartment comprises a plurality of grooves, slots, holes, or combinations thereof.

4. The device of claim 1, wherein each separator comprises a integral handle end configured for removing said separate from said main body, said handle end extending outside the main body.

5. The device of claim 4, wherein a pair of opposing edges of each separator slidingly engages a pair of horizontal tracks on the interior of the main body.

6. The device of claim 1, wherein the main body is waterproof or water-resistant.

7. The device of claim 1, further comprising two or more hooks extending from the main body.

8. The device of claim 1, wherein the main body is luminescent or phosphorescent.

9. The device of claim 4, wherein each separator extends out through a corresponding opening in a side of the main body.

10. The device of claim 9, comprising sealing means for sealing the corresponding openings.

11. The apparatus of claim 10, wherein said sealing means comprises rubber or foam.

12. The device of claim 1, further comprising a plurality of suction cups disposed on the back of the main body.

13. The device of claim 1, wherein the right side or left side of the main body comprises a removable side, in whole or in part.

14. The device of claim 13, wherein the removable side is hingedly attached to the top of the main body.

15. An apparatus, comprising:

a soap dispenser comprising a main body with a front, back, top, bottom, and right and left side encompassing a hollow interior, the interior comprising a plurality of compartments, said plurality of compartments comprising a bottommost compartment disposed at the bottom of the main body, a first compartment disposed vertically above said bottommost compartment, and at least one additional compartment disposed vertically above said first compartment, each compartment adapted to hold a bar of soap, the bottommost compartment being open on one or more sides, and a plurality of separators separating adjacent compartments, wherein each separator extends out through a corresponding slot in the front, right or left side of the main body and is removable therethrough;

a plurality of bars of soap, each bar of soap placed in said first compartment and in said at least one additional compartment disposed vertically above said first compartment.

16. The apparatus of claim 13, further comprising a plurality of suction cups on the back of the main body.

* * * * *